US010605457B2

(12) United States Patent
Beck et al.

(10) Patent No.: US 10,605,457 B2
(45) Date of Patent: Mar. 31, 2020

(54) BURNER ARRANGEMENT WITH RESONATOR

(71) Applicant: Siemens Aktiengesellschaft, Munich (DE)

(72) Inventors: Christian Beck, Essen (DE); Olga Deiss, Düsseldorf (DE); Patrick Ronald Flohr, Mülheim a.d. Ruhr (DE); Anna Knödler, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 531 days.

(21) Appl. No.: 15/310,648

(22) PCT Filed: Apr. 17, 2015

(86) PCT No.: PCT/EP2015/058407
§ 371 (c)(1),
(2) Date: Nov. 11, 2016

(87) PCT Pub. No.: WO2015/176887
PCT Pub. Date: Nov. 26, 2015

(65) Prior Publication Data

US 2017/0082287 A1 Mar. 23, 2017

(30) Foreign Application Priority Data

May 19, 2014 (DE) ..... 10 2014 209 446

(51) Int. Cl.
*F23M 20/00* (2014.01)
*F23R 3/10* (2006.01)
(Continued)

(52) U.S. Cl.
CPC ..... *F23M 20/005* (2015.01); *F23R 3/10* (2013.01); *F23R 3/286* (2013.01); *F23R 3/42* (2013.01);
(Continued)

(58) Field of Classification Search
USPC ..... 431/114
See application file for complete search history.

(56) References Cited

U.S. PATENT DOCUMENTS 4,122,674 A 10/1978 Andersson et al.
5,373,695 A 12/1994 Aigner et al.
(Continued)

FOREIGN PATENT DOCUMENTS

CN 102472493 A 5/2012
CN 102901125 A 1/2013
(Continued)

OTHER PUBLICATIONS

IPRP (PCT/IPEA416), dated Apr. 13, 2016, for PCT application No. PCT/EP2015/058407.
(Continued)

*Primary Examiner* — Steven B Mcallister
*Assistant Examiner* — John E Bargero
(74) *Attorney, Agent, or Firm* — Beusse Wolter Sanks & Maire

(57) ABSTRACT

A burner arrangement having a combustion chamber, a multiplicity of mixing ducts discharging into the combustion chamber, in which ducts combustion air and fuel introduced during proper operation are mixed, and at least one resonator which has a defined resonator volume and resonator openings. The mixing ducts have mixing tubes which extend axially through an annular space defined between a tubular outer wall, a tubular inner wall arranged with the radial separation from the outer wall, an annular end plate arranged
(Continued)

upstream and an annular end plate arranged downstream, wherein the end plates are provided with through openings which receive and/or prolong the mixing tubes. The resonator openings of the at least one resonator are designed as air ducts that extend through the downstream end plate, and the resonator volume of the at least one resonator is formed by at least one part of the annular space.

13 Claims, 3 Drawing Sheets

(51) Int. Cl.
*F23R 3/28* (2006.01)
*F23R 3/42* (2006.01)

(52) U.S. Cl.
CPC ..... *F23R 2900/00013* (2013.01); *F23R 2900/00014* (2013.01)

(56) References Cited

U.S. PATENT DOCUMENTS

| | | | | |
|---|---|---|---|---|
| 7,827,797 | B2 * | 11/2010 | Han | F23R 3/286 60/746 |
| 8,127,546 | B2 * | 3/2012 | Park | F23R 3/28 181/213 |
| 8,438,851 | B1 | 5/2013 | Uhm et al. | |
| 2005/0106519 | A1 | 5/2005 | Flohr et al. | |
| 2006/0059913 | A1 | 3/2006 | Bethke et al. | |
| 2008/0245072 | A1 | 10/2008 | Maeding | |
| 2010/0011769 | A1 * | 1/2010 | Gambacorta | F23M 20/005 60/725 |
| 2010/0218501 | A1 * | 9/2010 | York | F23R 3/286 60/737 |
| 2010/0300106 | A1 * | 12/2010 | Edwards | F23R 3/10 60/752 |
| 2011/0016871 | A1 * | 1/2011 | Kraemer | F23N 5/082 60/772 |
| 2011/0179795 | A1 | 7/2011 | Johnson et al. | |
| 2012/0125006 | A1 | 5/2012 | Keijiro et al. | |
| 2012/0180495 | A1 | 7/2012 | Uhm et al. | |
| 2013/0019602 | A1 * | 1/2013 | Kim | F23R 3/10 60/725 |
| 2013/0029277 | A1 | 1/2013 | Koizumi et al. | |
| 2013/0042627 | A1 | 2/2013 | Gerendas et al. | |
| 2013/0318977 | A1 | 12/2013 | Berry et al. | |

FOREIGN PATENT DOCUMENTS

| | | | |
|---|---|---|---|
| CN | 103453554 | A | 12/2013 |
| DE | 3432607 | A1 | 3/1986 |
| DE | 102004018725 | A1 | 11/2005 |
| DE | 102010016547 | A1 | 1/2011 |
| EP | 0597138 | A1 | 5/1994 |
| EP | 1481195 | B1 | 6/2010 |
| EP | 1792123 | B1 | 11/2010 |
| EP | 2559942 | A1 | 2/2013 |

OTHER PUBLICATIONS

DE Search Report, dated Feb. 3, 2015, for DE application No. 102014209446.1.
International Search Report, dated Jul. 7, 2015, for PCT application No. PCT/EP2015/058407.
CN search report dated Jul. 18, 2018, for CN patent application No. 201580025974.8.

* cited by examiner

BURNER ARRANGEMENT WITH RESONATOR

CROSS REFERENCE TO RELATED APPLICATIONS

This application is the US National Stage of International Application No. PCT/EP2015/058407 filed Apr. 17, 2015, and claims the benefit thereof. The International Application claims the benefit of German Application No. DE 102014209446.1 filed May 19, 2014. All of the applications are incorporated by reference herein in their entirety.

FIELD OF INVENTION

The invention relates to a burner arrangement with a combustion chamber, a plurality of mixing ducts leading into the combustion chamber, in which ducts combustion air and fuel introduced during proper operation are mixed, and at least one resonator, which comprises a defined resonator volume and resonator openings.

BACKGROUND OF INVENTION

Various configurations of burner arrangements are known from the prior art. During operation of a burner arrangement, such as for example the burner arrangement of a gas turbine, thermoacoustically induced combustion oscillations arise in the combustion chamber. These may excite components of the burner arrangement to oscillate. If an exciting oscillation coincides with a resonant frequency of the burner arrangement or the components thereof, this may result in the destruction of components. Excitation of the burner arrangement and the components thereof in the range of such resonant frequencies must accordingly be avoided.

It is already known to modify the acoustic characteristics of burner arrangements and the components thereof by installing resonators which operate according to the Helmholtz principle. Thus, for example, document EP 2 559 942 A1 discloses a resonator which is arranged in the combustion chamber hood or in the region of the cooling air feed line. A disadvantage of such an arrangement lies, however, in the fact that damping does not take place directly at the point of origin of the oscillation in the region of the combustion chamber and is thus of low efficiency.

It is also known to place resonators directly on the circumference of the combustion chamber wall. This allows effective damping in the region of heat release. However, such resonators must be cooled with a large volumetric flow rate of cooling air. This air is no longer directly available for the combustion process, which leads to higher NOx emissions.

To reduce this problem, EP 1 792 123 B1 proposes guiding compressed air into the combustion chamber through resonator devices incorporated into the combustion chamber wall. The advantage of this design lies in the coupling of wall cooling and resonator purging and in incorporating medium and high frequency resonators in the combustion chamber wall. A disadvantage, however, is the double-walled embodiment of the combustion chamber wall, which entails significant constructional effort and high costs.

Document EP 1 481 195 B1 proposes arranging resonators between a fuel introduction point and the combustion chamber. However, this represents direct influencing of the fuel mass flow rate, which is considered disadvantageous.

Furthermore, resonators configured in this way are not suitable for covering a broad frequency range.

EP 0 597 138 A1 describes a gas turbine combustion chamber which comprises air-purged resonators distributed in the circumferential direction in the region of the combustion chamber inlet. Here too, however, the problem arises that the cooling air is not directly available for combustion and NOx emissions therefore rise.

SUMMARY OF INVENTION

Starting from this prior art, it is an object of the present invention to provide a burner arrangement of the above-stated type with an alternative structure.

To achieve this object, the present invention provides a burner arrangement of the above-stated type which is characterized in that the mixing ducts are formed by mixing pipes, which extend axially through an annular space defined between a tubular outer wall, a tubular inner wall arranged radially at a distance from the outer wall, an annular end plate arranged upstream and an annular end plate arranged downstream, wherein the end plates are provided with passage openings, which accommodate and/or continue the mixing pipes, in that the resonator openings of the at least one resonator take the form of air ducts, which extend through at least one of the end plates, and in that the resonator volume of the at least one resonator is formed by at least a portion of the annular space.

The structure of the burner arrangement according to the invention is advantageous on the one hand because material, cost and weight savings can be made owing to the mixing ducts being formed not by a solid nozzle holder but by individual mixing pipes. At the same time, the annular space is used as a resonator volume for the at least one resonator, so forming a resonator with a simple, inexpensive structure. The resonator is arranged adjacent the combustion chamber, such that it acts directly at the point of origin of the oscillations and thus effectively. Furthermore, it is provided on the cold side of the burner arrangement, for which reason it does not require any cooling.

According to one configuration of the present invention, at least one annular separator plate is provided between the upstream end plate and the downstream end plate, which separator plate comprises passage openings accommodating the mixing pipes and subdivides the annular space into annular space portions. Owing to such a separator plate, the resonator volume of the at least one resonator can be precisely adjusted.

According to one advantageous variant of the present invention, both the upstream end plate and the downstream end plate have air ducts, such that the annular space portions define resonator volumes of at least two resonators, which act on different frequencies on the one hand in the cold plenum space and on the other hand in the hot combustion chamber. For instance, the resonator facing the plenum space may for example act on pressure variations of the compressor.

Advantageously, the at least one separator plate is provided with a plurality of purging air ducts, through which cold air may enter at least one resonator facing the combustion chamber and purge it. The cold air also prevents hot combustion gases from entering the resonator.

Advantageously, the annular space portion defined between the at least one separator plate and the downstream end plate has a smaller volume than the annular space portion defined between the upstream end plate and the separator plate. Thus, the resonator with the smaller resonator volume is arranged as the high frequency resonator directly adjacent the combustion chamber, so as to damp the high frequency oscillations arising primarily in the combustion chamber. In contrast, the second resonator with the greater resonator volume provided adjacent the upstream end plate is configured as a medium frequency resonator.

Advantageously, the volume of the annular space portion defined between the separator plate and the downstream end plate amounts to no more than 20% of the volume of the annular space portions defined between the upstream end plate and the separator plate. Very good results have been achieved with this volume distribution.

According to one variant of the present invention, the annular space portion defined between the at least one separator plate and the downstream end plate is subdivided by radially extending partitions into a plurality of chambers. In other words, the above-described resonator, which is arranged adjacent the combustion chamber, is again subdivided into a plurality of smaller resonators. The air ducts provided in the downstream end plate, which form the resonator openings of these resonators, may vary as required in terms of number and diameter from resonator to resonator.

The volume of the chambers is advantageously different, in order to be able purposefully to cover different frequency ranges.

According to one configuration of the present invention, the upstream end plate takes the form of a carrier plate accommodating the mixing pipes and bearing their weight, which carrier plate is fastened for example to a flange plate, with which the entire burner arrangement is fastened to a machine housing or the like.

BRIEF DESCRIPTION OF THE DRAWINGS

Further features and advantages of the present invention are clear from the following description of a burner arrangement according to one embodiment of the present invention made with reference to the accompanying drawings, in which.

DETAILED DESCRIPTION OF INVENTION

Figure 1:
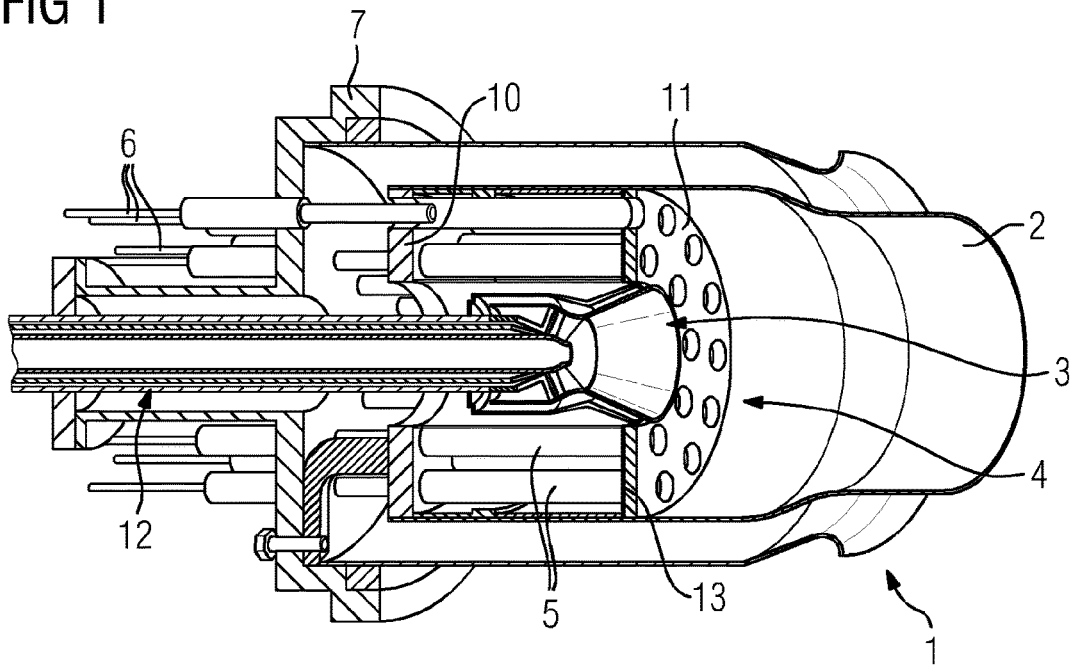
FIG. 1 is a schematic sectional view of a burner arrangement according to one embodiment of the present invention.
Figure 2:
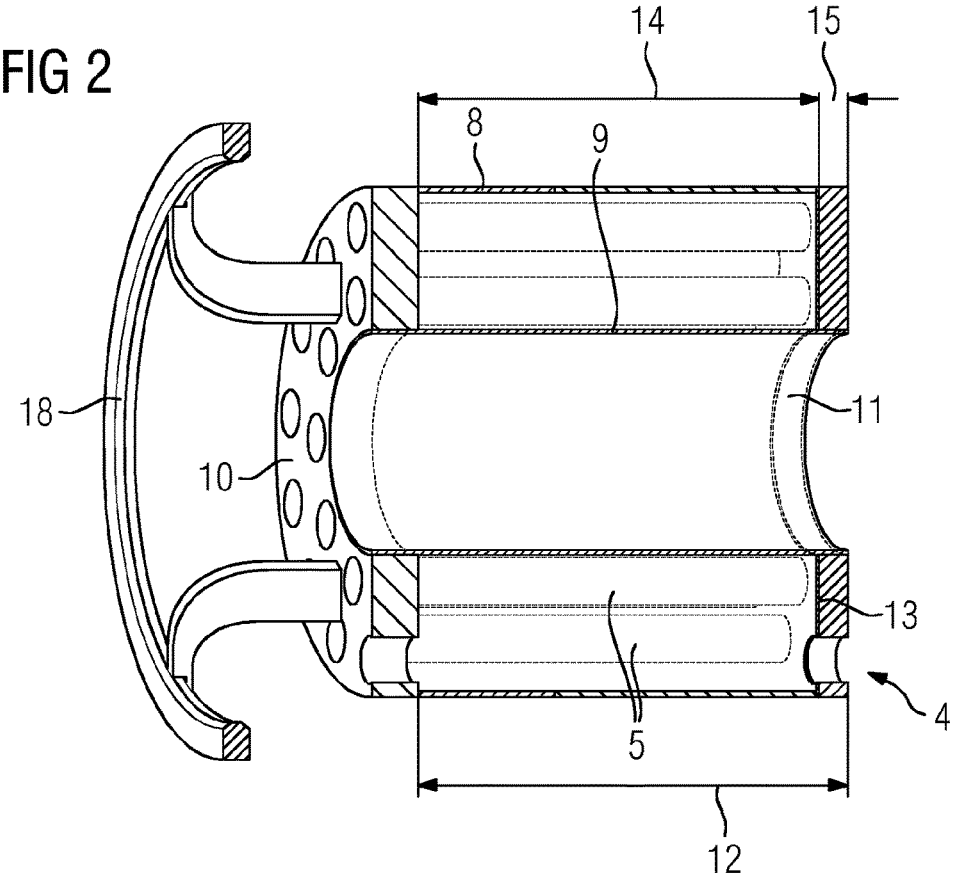
FIG. 2 is a sectional view of a mixing pipe arrangement of the burner arrangement depicted in FIG. 1.
Figure 3:
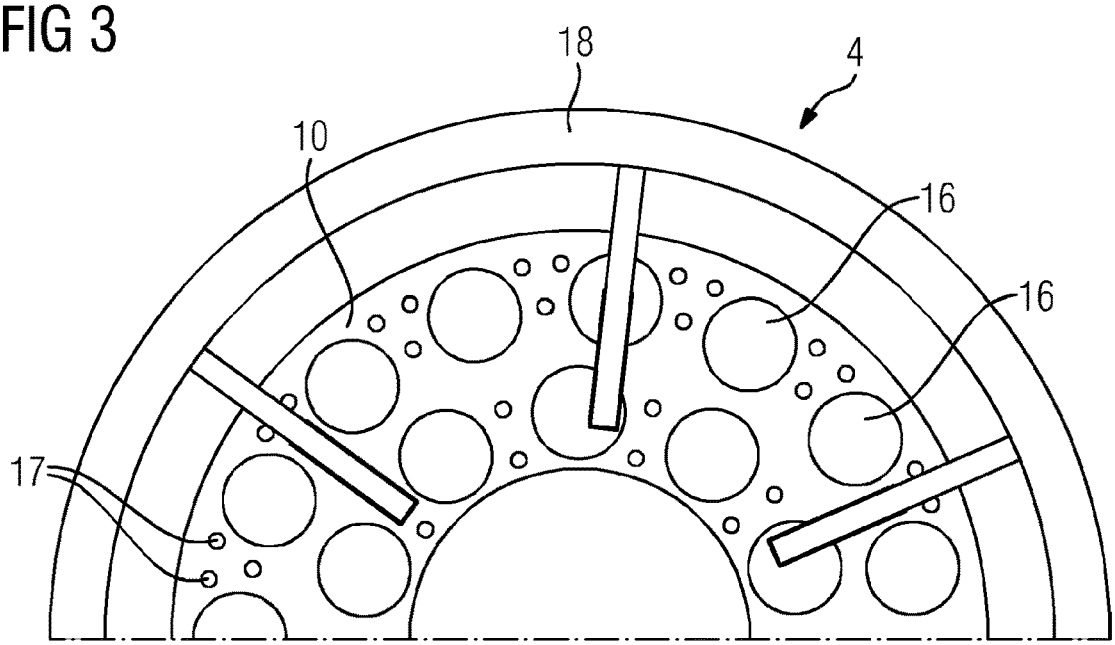
FIG. 3 is a partial rear view of the mixing pipe arrangement depicted in FIG. 2.
Figure 4:
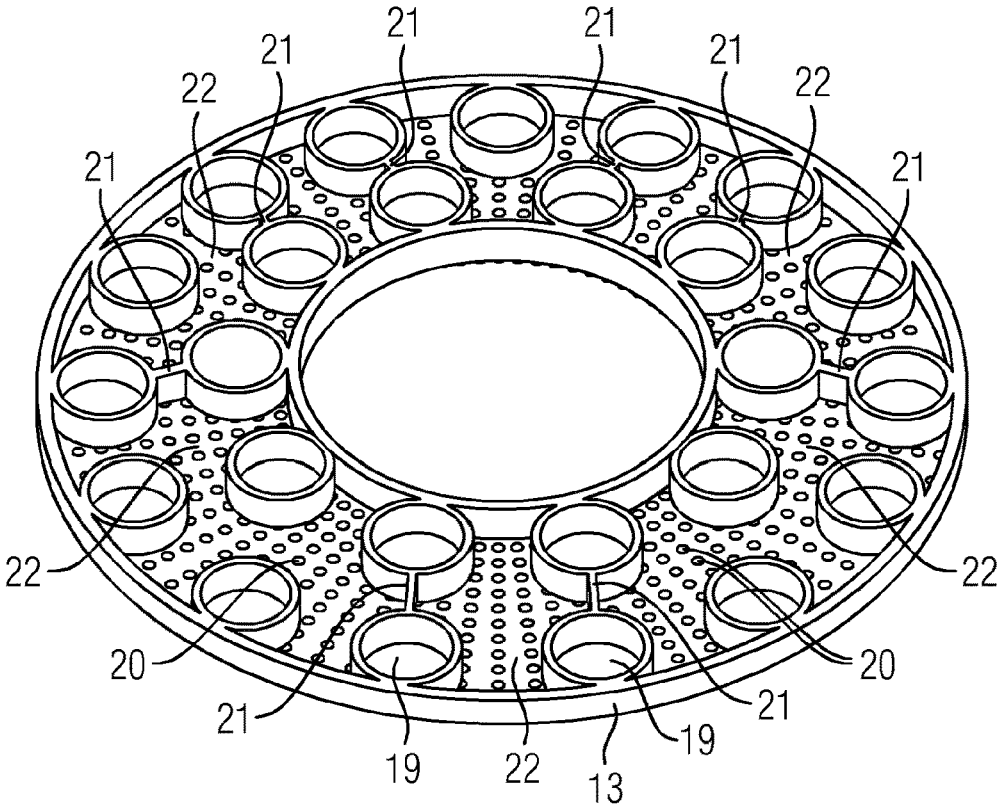
FIG. 4 is a view of a separator plate of the mixing pipe arrangement depicted in FIG. 2.
Figure 5:
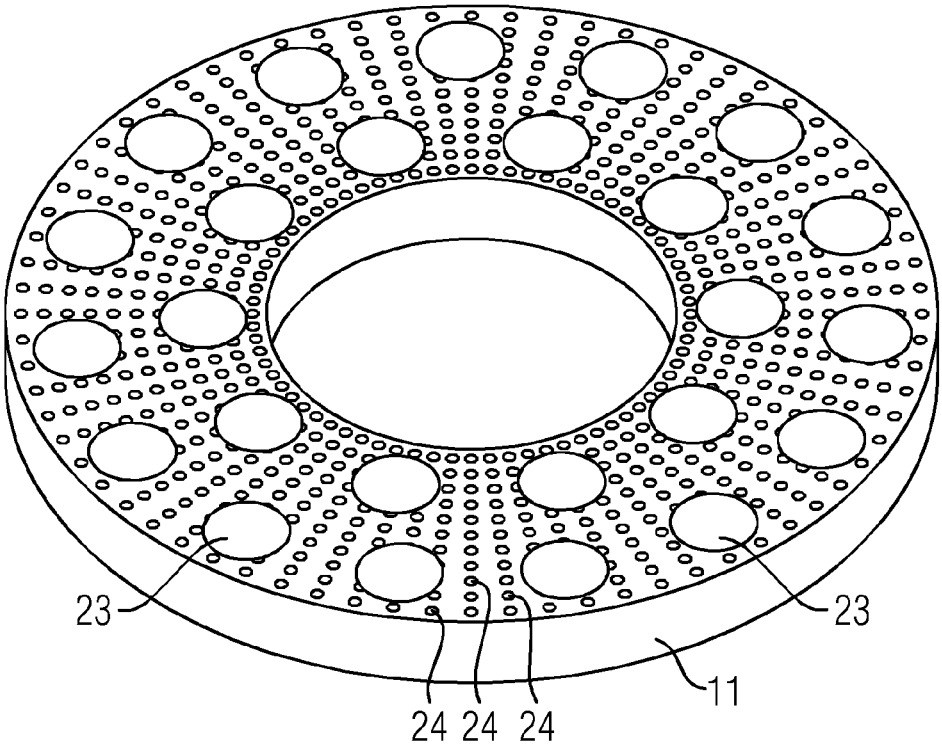
FIG. 5 is a view of a downstream end plate of the mixing pipe arrangement depicted in FIG. 2.

The figures show a burner arrangement 1 according to one embodiment of the present invention or components thereof. The burner arrangement 1 comprises a combustion chamber 2, a centrally arranged pilot burner 3, a mixing pipe arrangement 4 with a plurality of mixing pipes 5, which lead into the combustion chamber 2, a plurality of fuel injectors 6, which project into the mixing pipes 5 up to an appropriate position, and a mounting plate 7, which accommodates the mixing pipe arrangement 4 and serves to fasten the burner arrangement 1 to a machine housing not described in any greater detail.

The mixing pipe arrangement 4 comprises a tubular outer wall 8, a tubular inner wall 9 arranged radially at a distance from the outer wall 8, an annular end plate 10 arranged upstream and an end plate 11 arranged downstream, which latter define an annular space 12 through which the mixing pipes 5 extend in an axial direction. The mixing pipe arrangement 4 further comprises an annular separator plate 13, which subdivides the annular space 12 into two annular space portions 14 and 15. The annular space portion 15 defined between the separator plate 13 and the downstream end plate 11 has a significantly smaller volume than the annular space portion 14 defined between the upstream end plate 10 and the separator plate 13. In the present case, the volume of the annular space portion 15 corresponds for instance to 1/10 of the annular space portion 14.

The upstream end plate 10 comprises a plurality of passage openings 16, which accommodate and/or continue the mixing pipes 5. In the present case, the passage openings 16 define two circles of holes with different hole circle diameters, wherein the passage holes 16 in the first circle of holes and the passage holes 16 in the second circle of holes are arranged offset relative to one another in the radial direction. Furthermore, the end plate 10 comprises a plurality of air ducts 17, which extend in the axial direction and are distributed over the annular surface of the end plate 10. In the present case, 45 air ducts 17 each with a diameter of 5 mm are provided, to mention just one example. It should however be clear that the number and diameter of the air ducts 17 may be varied as required. The end plate 10 forms the carrier plate of the entire mixing pipe arrangement 4, for which reason it is accordingly solid. A mounting means 18 is fastened to the end plate 10, which serves to fasten the mixing pipe arrangement 4 to the mounting plate 7 of the burner arrangement 1.

Like the end plate 10, the separator plate 13 is provided with passage openings 19, which are aligned axially with the passage openings 16 in the end plate 10. In addition, the separator plate 13 is provided with a plurality of purging air ducts 20, which are distributed over the annular surface of the separator plate 13 and connect the annular space portion 14 flow-wise to the annular space portion 15. In the present case, 500 purging air ducts 20 with a diameter in the range from 1-1.3 mm are formed in the separator plate 13, to mention just one example, wherein the number and diameters of the purging air ducts 20 may vary as required. Furthermore, radially extending partitions 21 are formed on the separator plate 13, which subdivide the annular space portion 15 into a plurality of chambers 22 with different volumes.

Like the end plate 10 and the separator plate 13, the downstream end plate 11 comprises passage openings 23, which are axially aligned with the passage openings 16 in the end plate 10 and the passage openings 19 in the separator plate 13. In addition, axially extending air ducts 24 are formed in the end plate 11, which connect the annular space portion 15 flow-wise to the combustion chamber 2.

In the assembled state, the partitions 21 of the separator plate 13 rest against the end plate 11, forming the above-mentioned chambers 22. The chambers 22 each define resonator volumes of high frequency resonators, the resonator openings of which are formed by the air ducts 24 which connect the annular space portion 15 to the combustion chamber 2. Because the volumes of the individual chambers 22 are selected to be different, the high frequency resonators damp different frequencies. For instance, to mention just one example, high frequency resonators may be provided which damp frequencies of between 1000 Hz and 5000 Hz. The number and diameters of the air ducts 17 provided in each chamber varies as required as a function of the frequencies to be damped. The purging air ducts 20 provided in the separator plate 13 define purging air openings for the high frequency resonators, which on the one hand prevent hot air from entering the annular space portion 14 and on the other hand ensure sufficient cooling.

The annular space portion 14 defines the resonator volume of a medium frequency resonator acting on the cold plenum space, the resonator openings of which form the air ducts 17 in the end plate 10. For the medium frequency resonator, the purging air ducts 20 formed in the separator plate 13 ensure a broadening of the frequency range to be damped. The resonator volume of the medium frequency resonator may for example be selected such that a resonator frequency in the region of 170 Hz is established.

A significant advantage of the above-described burner arrangement 1 lies in the fact that a plurality of resonators are formed in integral manner with the mixing pipe arrangement 4. In this way, effective damping is achieved at highly varied frequencies without additional installation space and at low cost.

The resonators provide both upstream and downstream damping, so preventing damage to components. Thanks to the division of the resonators into a medium frequency resonator and a plurality of high frequency resonators and thanks to the selection of the resonator arrangement, damping is in each case provided where it is immediately needed. The medium frequency resonator acts, on the cold side towards the plenum space, on low-frequency pressure variations, while the high frequency resonators act on high frequency pressure variations in the combustion chamber.

The medium frequency resonator is coupled to the high frequency resonators via the purging air ducts 20 provided in the separator plate 13. A particular feature thereof is that this coupling does not influence the frequencies of the individual resonators. Rather, all the resonators may be set individually and mutually independently to predetermined frequencies. This effect is achieved in that the acoustically active openings act simultaneously in different directions, specifically towards the plenum on the one hand and towards the combustion chamber on the other hand.

The purging air mass flow rate adjustable by way of the design solves a number of problems. Firstly, the damping spectra of the individual resonators are broadened in terms of the frequency thereof. Secondly, the high frequency resonators are closed against the penetration of hot gas from the combustion chamber. Furthermore, the temperature of the resonators is controlled and, in addition, the mixing pipe arrangement is cooled on the hot side.

Although the invention has been illustrated and described in greater detail with reference to the preferred exemplary embodiment, the invention is not restricted by the disclosed examples and other variations may be derived therefrom by a person skilled in the art without going beyond the scope of protection of the invention.

The invention claimed is:

1. A burner arrangement, comprising:

a combustion chamber, a plurality of mixing ducts leading into the combustion chamber, in which ducts combustion air and fuel introduced during proper operation are mixed, and at least one resonator, which comprises a defined resonator volume and resonator openings, wherein the plurality of mixing ducts are formed by mixing pipes, which extend axially through an annular space defined between a tubular outer wall, a tubular inner wall arranged radially at a distance from the tubular outer wall, an annular upstream end plate arranged upstream directly adjacent an air plenum and an annular downstream end plate arranged downstream directly adjacent the combustion chamber, the end plates comprising passage openings, which accommodate and/or continue the mixing pipes, wherein the resonator openings of the at least one resonator take the form of air ducts, which extend through at least one of the end plates, and the resonator volume of the at least one resonator is formed by at least a portion of the annular space, at least one annular separator plate between the upstream end plate and the downstream end plate, which separator plate comprises passage openings accommodating the mixing pipes and subdivides the annular space into annular space portions, radially extending partitions disposed between the at least one annular separator plate and the downstream end plate, wherein each partition of the radially extending partitions terminates on one end at the at least one annular separator plate and on an opposite and at the downstream end plate, wherein both the upstream end plate and the downstream end plate comprise air ducts, such that the annular space portions define resonator volumes of at least two resonators, which act on different frequencies on the one hand in the air plenum and on the other hand in the combustion chamber.

2. The burner arrangement as claimed in claim 1, wherein the at least one annular separator plate comprises a plurality of purging air ducts, which connect the annular space portions together flow-wise.

3. The burner arrangement as claimed in claim 1, wherein an annular space portion defined between the at least one annular separator plate and the downstream end plate comprises a smaller volume than the annular space portion defined between the upstream end plate and the separator plate.

4. The burner arrangement as claimed in claim 3, wherein the volume of the annular space portion defined between the separator plate and the downstream end plate amounts to no more than 20% of a volume of the annular space portion defined between the upstream end plate and the separator plate.

5. The burner arrangement as claimed in claim 1, wherein an annular space portion of the annular space portions that is defined between the at least one annular separator plate and the downstream end plate is subdivided by the radially extending partitions into a plurality of chambers, wherein each chamber of the plurality of chambers comprises a volume, and wherein the radially extending partitions are unequally circumferentially distributed so the volumes are not all the same.

6. The burner arrangement as claimed in claim 1, wherein the upstream end plate takes the form of a carrier plate accommodating the mixing pipes and bearing their weight.

7. An apparatus, comprising:

a combustion chamber and a resonator arrangement, the resonator arrangement comprising;

a tubular outer wall; a tubular inner wall arranged at a distance from the tubular outer wall; an annular space formed between the tubular outer wall and the tubular inner wall; an upstream end plate directly adjacent a cold air plenum and which bounds an upstream end of the annular space and comprises upstream end plate air holes and upstream end plate passage openings therethrough; a downstream end plate directly adjacent the combustion chamber and which bounds a downstream end of the annular space and comprises downstream end plate air holes and downstream end plate passage openings therethrough; a separator plate disposed in the annular space closer to the downstream end plate than the upstream end plate, which separates the annular space into an upstream larger annular space and a downstream smaller annular space, and which comprises separator plate passage openings therethrough;

plural mixing tubes, each mixing tube of the plural mixing tubes passing through the annular space, the upstream end plate, the separator plate, and the downstream end plate, each mixing tube fluidically isolated from the annular space, and each mixing tube configured to: receive a respective airflow from the cold air plenum upstream of the upstream end plate; to receive a respective fuel flow; to mix therein the respective airflow and the respective fuel flow; and to deliver a discrete mixture of the respective airflow and the respective fuel flow to the combustion chamber; and wherein the upstream end plate passage openings accommodate the plural mixing tubes, and the upstream end plate air holes are smaller than and disposed between the upstream end plate passage holes, wherein the larger annular space acts as a medium-frequency resonator.

8. The apparatus of claim 7, further comprising;

plural fuel lances, wherein the respective fuel flow for each mixing tube is delivered by a respective fuel lance of the plural fuel lances.

9. The apparatus of claim 7, further comprising a pilot burner disposed within the tubular inner wall.

10. The apparatus of claim 7, wherein at least two mixing tubes of the plural mixing tubes are disposed at different radial positions within the annular space relative to a longitudinal axis of the annular space.

11. The apparatus of claim 10, wherein a first group of mixing tubes of the plural mixing tubes are arranged in a first circle, and wherein a second group of mixing tubes of the plural mixing tubes are arranged in a second circle comprising a larger diameter than a diameter of the first circle.

12. The apparatus of claim 11, wherein mixing tubes of the first group of mixing tubes are circumferentially offset from mixing tubes of the second group of mixing tubes.

13. The apparatus of claim 7, further comprising radially extending partitions disposed between the separator plate and the downstream end plate, wherein each partition of the radially extending partitions terminates on one end at the separator plate and on an opposite and at the downstream end plate.

* * * * *